US006905411B2

(12) United States Patent
Nguyen et al.

(10) Patent No.: US 6,905,411 B2
(45) Date of Patent: Jun. 14, 2005

(54) PLAYER AUTHENTICATION FOR CASHLESS GAMING MACHINE INSTRUMENTS

(75) Inventors: Binh T. Nguyen, Reno, NV (US); Craig A. Paulsen, Reno, NV (US)

(73) Assignee: IGT, Reno, NV (US)

( * ) Notice: Subject to any disclaimer, the term of this patent is extended or adjusted under 35 U.S.C. 154(b) by 430 days.

(21) Appl. No.: 10/085,154

(22) Filed: Feb. 27, 2002

(65) Prior Publication Data

US 2003/0162591 A1 Aug. 28, 2003

(51) Int. Cl.[7] ..... A63F 9/24
(52) U.S. Cl. ..... 463/25; 463/42
(58) Field of Search ..... 463/16–29, 40–42; 713/186; 235/380; 902/23

(56) References Cited

U.S. PATENT DOCUMENTS

| | | | | | |
|---|---|---|---|---|---|
| 4,385,285 | A | * | 5/1983 | Horst et al. | 382/119 |
| 5,038,022 | A | | 8/1991 | Lucero | |
| 5,179,517 | A | | 1/1993 | Sarbin et al. | |
| 5,195,133 | A | * | 3/1993 | Kapp et al. | 705/75 |
| 5,265,874 | A | | 11/1993 | Dickinson et al. | |
| 5,470,079 | A | | 11/1995 | LeStrange et al. | |
| 5,513,272 | A | * | 4/1996 | Bogosian, Jr. | 382/116 |
| 5,902,983 | A | | 5/1999 | Crevelt et al. | |
| 5,954,583 | A | * | 9/1999 | Green | 463/29 |
| 6,104,815 | A | | 8/2000 | Alcorn et al. | |
| 6,193,152 | B1 | * | 2/2001 | Fernando et al. | 235/380 |
| 6,227,972 | B1 | | 5/2001 | Walker et al. | |
| 6,234,900 | B1 | | 5/2001 | Cumbers | |
| 6,500,067 | B1 | * | 12/2002 | Luciano et al. | 463/25 |
| 6,511,377 | B1 | * | 1/2003 | Weiss | 463/25 |
| 6,612,928 | B1 | * | 9/2003 | Bradford et al. | 463/29 |
| 6,652,380 | B1 | * | 11/2003 | Luciano | 463/25 |
| 6,675,152 | B1 | * | 1/2004 | Prasad et al. | 705/64 |
| 6,690,673 | B1 | * | 2/2004 | Jarvis | 370/401 |
| 6,709,333 | B1 | * | 3/2004 | Bradford et al. | 463/29 |
| 2001/0018660 | A1 | * | 8/2001 | Sehr | 705/5 |
| 2002/0113124 | A1 | * | 8/2002 | Meyerhofer et al. | 235/454 |
| 2002/0181007 | A1 | * | 12/2002 | Brooks et al. | 358/1.14 |
| 2003/0038176 | A1 | * | 2/2003 | Dabrowski | 235/381 |
| 2003/0078094 | A1 | * | 4/2003 | Gatto et al. | 463/25 |
| 2003/0100371 | A1 | * | 5/2003 | Gatto et al. | 463/42 |
| 2004/0030655 | A1 | * | 2/2004 | Tanaka et al. | 705/56 |

FOREIGN PATENT DOCUMENTS

| | | | |
|---|---|---|---|
| EP | 1 120 757 A2 | * | 1/2001 |
| WO | WO 94/10658 | * | 5/1994 |
| WO | WO 94/16416 | * | 7/1994 |

* cited by examiner

*Primary Examiner*—Michael O'Neill
(74) *Attorney, Agent, or Firm*—Beyer, Weaver & Thomas, LLP.

(57) ABSTRACT

A method and gaming machine/system designed or configured to provide security to cashless gaming system instruments, such as EZ PAY tickets, by placing authentication information data on the ticket. Player authentication data is acquired via an interface provided by a gaming machine and the data is then placed on a cashless instrument so that it may later be read and authenticated. Such instruments could then only be negotiated by the person identified by the player authentication data placed on the instrument.

42 Claims, 4 Drawing Sheets

PLAYER AUTHENTICATION FOR CASHLESS GAMING MACHINE INSTRUMENTS

BACKGROUND OF THE INVENTION

This invention relates to game playing services for gaming machines such as slot machines and video poker machines. More particularly, the present invention relates to methods of authenticating cashless instruments, such as vouchers, in gaming machine systems.

There are a wide variety of associated devices that can be connected to a gaming machine such as a slot machine or video poker machine. Some examples of these devices are lights, ticket printers, card readers, speakers, bill validators, ticket readers, coin acceptors, display panels, key pads, coin hoppers and button pads. Many of these devices are built into the gaming machine or components associated with the gaming machine such as a top box which usually sits on top of the gaming machine.

Typically, utilizing a master gaming controller, the gaming machine controls various combinations of devices that allow a player to play a game on the gaming machine and also encourage game play on the gaming machine. For example, a game played on a gaming machine usually requires a player to input money or indicia of credit into the gaming machine, indicate a wager amount, and initiate a game play. These steps require the gaming machine to control input devices, including bill validators and coin acceptors, to accept money into the gaming machine and recognize user inputs from devices, including key pads and button pads, to determine the wager amount and initiate game play. After game play has been initiated, the gaming machine determines a game outcome, presents the game outcome to the player and may dispense an award of some type depending on the outcome of the game.

As technology in the gaming industry progresses, the traditional method of dispensing coins or tokens as awards for winning game outcomes is being supplemented by ticket dispensers which print ticket vouchers that may be exchanged for cash or accepted as credit of indicia in other gaming machines for additional game play. An award ticket system, which allows award ticket vouchers to be dispensed and utilized by other gaming machines, increases the operational efficiency of maintaining a gaming machine and simplifies the player pay out process. An example of an award ticket system is the EZ PAY ticket system by International Game Technology (IGT) of Reno, Nev. Award ticket systems and systems using other cashless mediums are referred to as cashless systems.

Cashless systems, such as the EZ PAY ticket system, provide advantages to both game players and casino operators. For example, many players find it more convenient to carry an award ticket than a large number of coins. For gaming machine operators cashless systems tend to reduce gaming machine operating costs. For example, the infrastructure needed to remove and count indicia of credit (e.g. coins, tokens, bills) from the gaming machine may be eliminated or minimized when it is replaced with a cashless system, which reduces the gaming machine operating costs. Further, coin dust, which is potentially damaging to the components of the gaming machine (e.g. electronic components) may be eliminated or minimized when coin acceptors are replaced with the cashless system.

Currently, cashless systems have become very popular and have been embraced by customers. For example, ticket vouchers that are generated upon cash-out and redeemed for cash or gaming machine credits within a particular casino are well accepted by game players. However, currently, vouchers, such as EZ PAY tickets, can be used for game play in a gaming machine or redeemed for cash by anyone who has possession of the voucher, whether or not the rightful owner. If there were a way to add a security aspect to cashless gaming vouchers to identify the owner, player trust and acceptability would be enhanced.

SUMMARY OF THE INVENTION

This invention addresses the needs indicated above by providing a gaming system and method designed or configured to provide security to cashless gaming system instruments, such as EZ PAY ticket vouchers, by placing player authentication data, such as a signature, photo, biometric data, birth date, social security number, a PIN or password selected and entered by the player, or player identification data associated with a player tracking system operating on the gaming system, on the instrument. A player's authentication data may be acquired via an interface provided by a gaming machine and the data is then placed on cashless gaming instrument, such as a voucher, so that it may later be read and authenticated. Such vouchers could then only be negotiated by the person identified by or with knowledge of the player authentication data on the instrument.

In accordance with the present invention, in order for a cashless gaming instrument to be used or cashed two things must be authenticated: 1) the value of the instrument (e.g., the amount of the payout) must be legitimate, and 2) the person using or cashing the instrument must be legitimate (i.e., the rightful owner or another authorized person). Among the advantages of the invention are that it enhances security and acceptability of cashless gaming systems and, in embodiments where it is implemented with player tracking systems, it allows an interface between player tracking and voucher authentication systems to the mutual benefit of the player and the gaming machine/system operator.

One aspect of the present invention relates to a method of authenticating a cashless gaming machine instrument. The method involves acquiring player authentication data via a device on a gaming machine and placing the player authentication data on the instrument. Validation of the player authentication data on the instrument is required for negotiation of the instrument.

In another aspect, the invention relates to a gaming machine. The gaming machine includes a master gaming controller designed or configured to control a game play sequence including a presentation of one or more games on the gaming machine. The machine also has a cashless gaming instrument input mechanism and a player authentication data acquisition mechanism coupled to the master gaming controller, and a cashless gaming machine instrument output mechanism designed or configured to generate a cashless gaming machine instrument and place player authentication data acquired by the acquisition mechanism on the instrument.

In another aspect, the invention relates to a cashless gaming machine instrument. The instrument includes an instrument medium and player authentication data identifying a gaming player as owner of the cashless instrument placed on the medium.

These and other features and advantages of the present invention are described below with reference to the drawings.

DETAILED DESCRIPTION OF SPECIFIC EMBODIMENTS

Reference will now be made in detail to specific embodiments of the invention. Examples of the specific embodiments are illustrated in the accompanying drawings. While the invention will be described in conjunction with these specific embodiments, it will be understood that it is not intended to limit the invention to such specific embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known process operations have not been described in detail in order not to unnecessarily obscure the present invention.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this invention belongs.

The present invention provides a gaming system and method designed or configured to provide security to cashless gaming system instruments, such as EZ PAY ticket vouchers, by placing player authentication data, such as a signature, photo, biometric data, birth date, social security number, a PIN or password selected and entered by the player, or player identification data associated with a player tracking system operating on the gaming system, on the instrument. A player's authentication data may be acquired via an interface provided by a gaming machine and the data is then placed on cashless gaming instrument, such as a voucher, so that it may later be read and authenticated. Such vouchers could then only be negotiated (i.e., used for game play or redeemed for cash or other value (e.g., prizes)) by the person identified by or with knowledge of the player authentication data on the instrument.

The present invention is implemented on a gaming machine. The gaming machine is typically one of several in a system of gaming machines and/or supporting devices interconnected via a host system as are known in the art. In one embodiment, the invention may be advantageously implemented in conjunction with a player tracking system.

Figure 1:
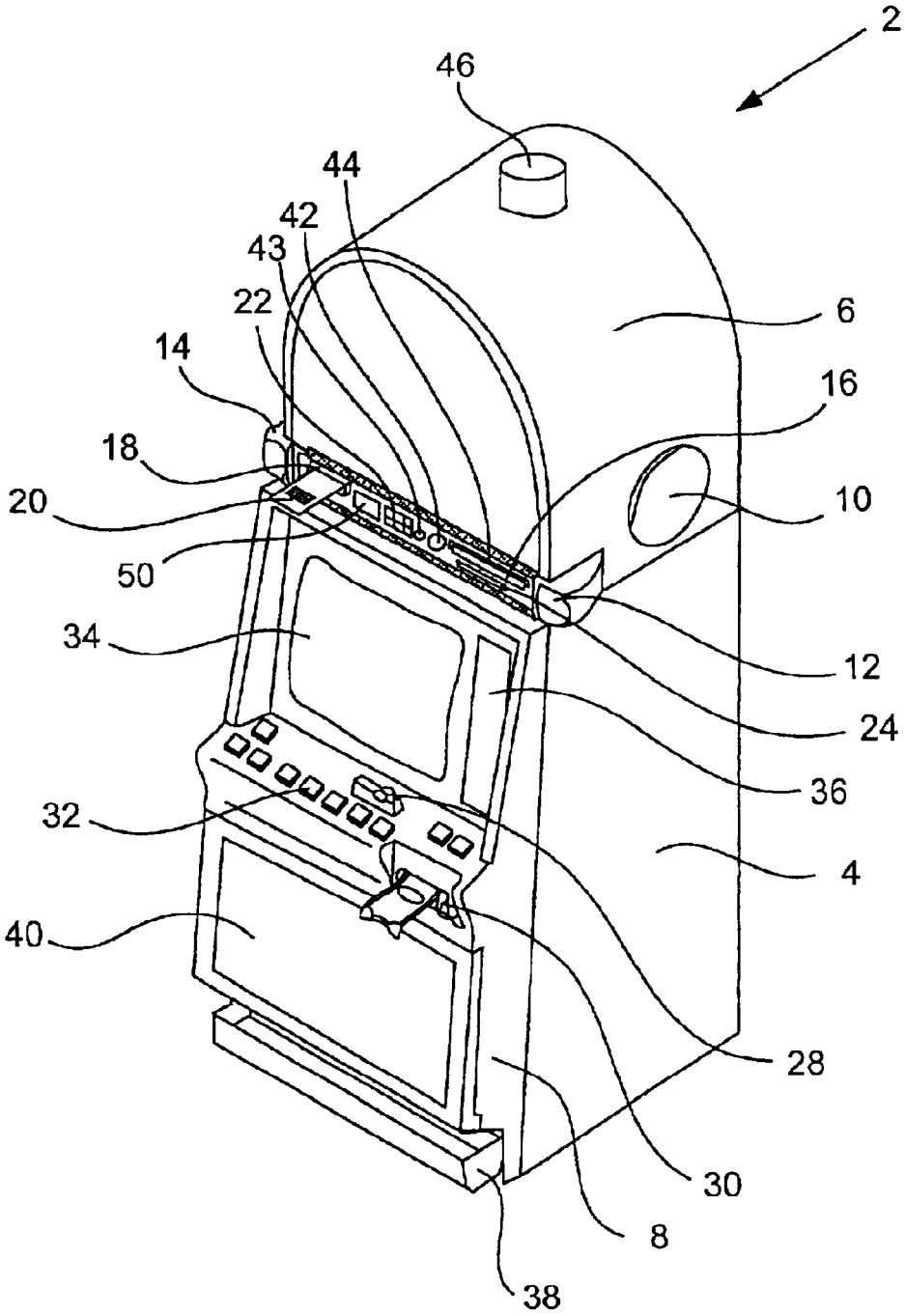
FIG. 1 is a perspective drawing of a gaming machine having a top box, player authentication data acquisition interfaces and other devices in accordance with the present invention.

FIG. 1 illustrates a video gaming machine suitable for implementation of the present invention. Machine 2 includes a main cabinet 4, which generally surrounds the machine interior (not shown) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a belly glass 40. Viewable through the main door is a video display monitor 34 and an information panel 36. The display monitor 34 will typically be a cathode ray tube, high resolution flat-panel LCD, or other conventional electronically controlled video monitor. The information panel 36 may be a back-lit, silk screened glass or plastic panel with lettering to indicate general game information including, for example, the number of coins played. The bill validator 30, player-input switches 32, video display monitor 34, and information panel are devices used to play a game on the game machine 2. The devices are controlled by circuitry (see FIG. 4) housed inside the main cabinet 4 of the machine 2. Many possible games, including traditional slot games, video slot games, video poker, video black jack, video keno, video pachinko, lottery games and other games of chance as well as bonus games may be provided with gaming machines of this invention.

The gaming machine 2 includes a top box 6, which sits on top of the main cabinet 4. The top box 6 houses a number of devices, which may be used to add features to a game being played on the gaming machine 2, including speakers 10, 12, 14, a ticket printer 18 which may print bar-coded tickets 20 used as cashless instruments, and one or more player authentication data acquisition interfaces 50. In this regard it should be noted that player authentication data may be entered or acquired via an interface that is dedicated to the player authentication purpose, or, more preferably, one that is available to receive input for a variety of purposes including player tracking, wagering, etc. The machine 2 may also include a player tracking unit mounted within the top box 6. The player tracking unit includes a key pad 22 for entering player tracking information, a display 16 for displaying player tracking information, a card reader 24 for entering a magnetic striped card containing player tracking information, a microphone 43 for inputting voice data, a speaker 42 for projecting sounds and a light panel 44 for display various light patterns used to convey gaming information. A player playing a game on the gaming machine 2 or a person near the gaming machine may view the light patterns from the light panel 16. In other embodiments, the player tracking unit and associated player tracking interface devices, such as 16, 22, 24, 42, 43 and 44, may be mounted within the main cabinet 4 of the gaming machine, on top of the gaming machine, or on the side of the main cabinet of the gaming machine.

Understand that gaming machine 2 is but one example from a wide range of gaming machine designs on which the present invention may be implemented. For example, not all suitable gaming machines have top boxes or player tracking features. Further, some gaming machines have two or more game displays—mechanical and/or video. And, some gaming machines are designed for bar tables and have displays that face upwards. Still further, some machines may be designed entirely for cashless systems. Such machines may not include such features as bill validators, coin acceptors and coin trays. Instead, they may have only ticket readers, card readers and ticket dispensers. Those of skill in the art will understand that the present invention, as described below, can be deployed on most any gaming machine now available or hereafter developed.

Figure 2:
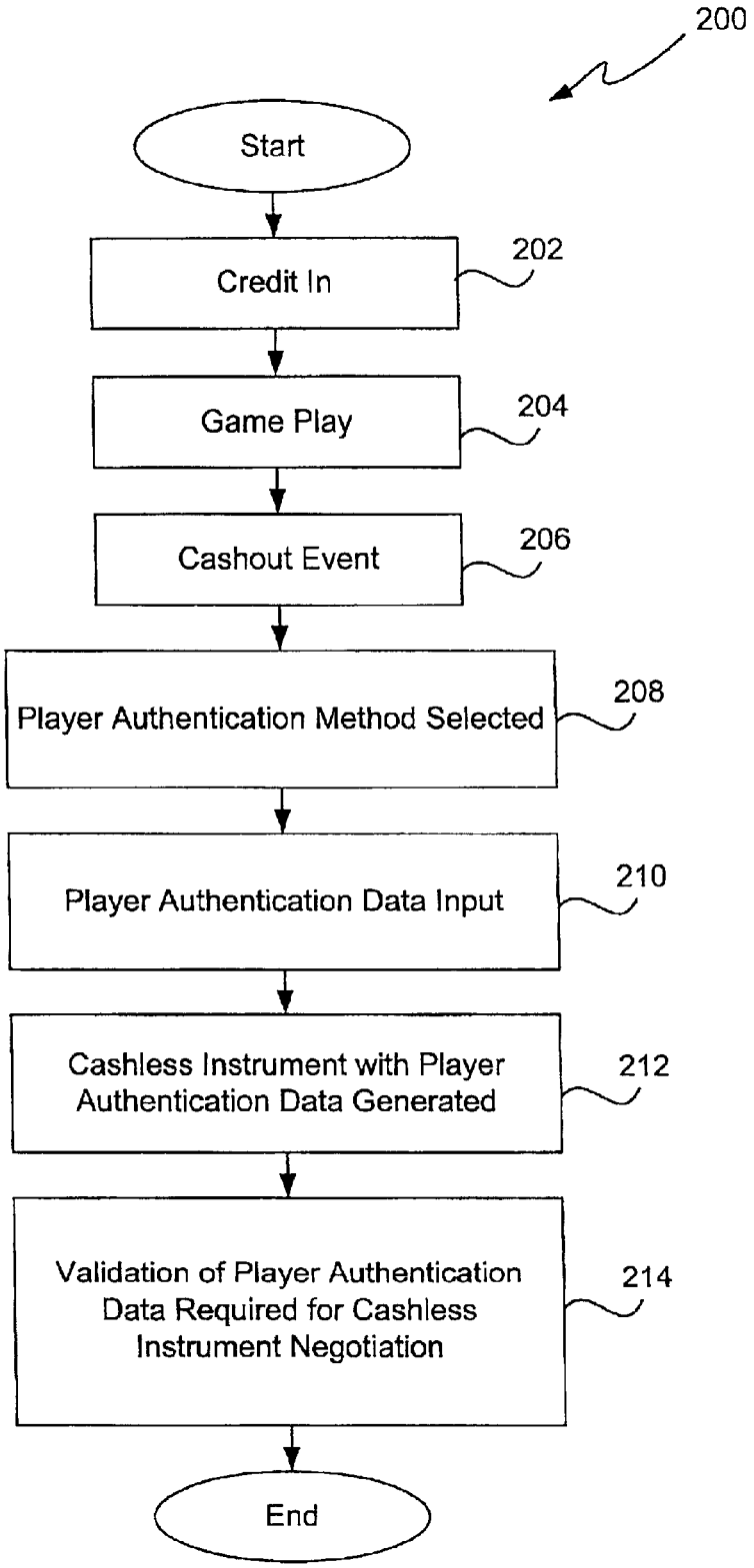
FIG. 2. is a flow chart depicting a method of providing player authentication for a cashless gaming instrument in accordance with the present invention.

FIG. 2. is a flow chart 200 depicting a method of providing player authentication data on a voucher in accordance with the present invention. At 202, a player adds credit to a gaming machine. Credit may be added by the player inserting cash through the machine's coin acceptor or bill validator. In addition, the player may use a cashless instrument of some type to register credits on the gaming machine. For example, the bill validator may accept a printed ticket voucher as an indicia of credit. As another example, the card reader 24 may accept a debit card, a smart card or a subscription card containing cash or credit information that may be used to register credits on the gaming machine. Credits can also be electronically transferred from an account previously established with the gaming establishment.

The cashless instrument typically contains information used to register credits on the gaming machine, and validate the registration transaction. For example, when a ticket voucher is used as a cashless instrument, the printed ticket voucher may contain information including: 1) a ticket value, 2) a ticket issue date, 3) a ticket issue time, 4) a ticket transaction number, 5) a machine ID, and 6) a ticket issue location. In addition, other types of information, besides the information listed above, may be stored on the cashless instrument. For example, the ticket may contain information regarding a promotional prize that may be won by the player when the ticket voucher is utilized in the gaming machine 2. The promotional prize may involve multiple properties and particular types of gaming machines.

As described further below, in accordance with the present invention, the cashless instrument may also contain player authentication data placed on the instrument when it was generated, for example, on cashout from another gaming machine. In accordance with some embodiments of the present invention, the gaming machine devices accepting cashless gaming instruments to add credits to the machine, such as bill validators and card readers, may be configured, for example, by logic stored in a memory associated with the devices, to look for player authentication data on a cashless gaming instrument. Where the instrument is found to have player authentication data, the machine may prompt the player to validate the player authentication data on the instrument, for example, by providing a password, PIN, or personal or biometric data associated with the player authentication data on the instrument via an interface provided on the machine, such as a keypad, touchscreen, scanner (e.g., in the bill validator, for scanning a piece of personal identification, such as a driver'e license or library card), or biometric device, such as a fingerprint scanner, etc. Without such validation, credits may not be added to the machine from the instrument. Where no player authentication data is found, player validation would not be required for credits to be added from the instrument.

The information on the cashless instrument may be recorded on the cashless instrument when the cashless instrument is generated. For example, in the case of a ticket voucher, the generation of the voucher may refer to the actual printing of the voucher on paper or some other medium. A unique barcode may be printed on the voucher which may be read with a barcode scanner to obtain information from the voucher. The ticket voucher 20, may be printed from a printer 18. In the case of the smart card or debit card, the generation of the smart card or debit card refers to storing or encoding this information on the smart card or debit card. The generation of the debit card or smart card may occur when the smart card or debit card is inserted into the card reader 24 in the gaming machine 2 or at another site where smart cards or debit cards are issued. For example, smart cards or debit cards may be generated at ATM like terminals, at a cashier station when a player cashes out or prepaid smart cards or debits may be purchased within the gaming property (e.g. casino).

In embodiments where player tracking is offered, prior to beginning a game play session on the gaming machine, a player may insert a player tracking card into a card reader 24 on the machine 2 to initiate a player tracking session. In a player tracking session on the gaming machine, features of the player's game play during a game play session on the gaming machine, such as an amount wagered during the game play session, may be converted to player tracking points and stored in the player's player tracking account on a player tracking server to which the gaming machine is connected in a network. Later, accumulated player tracking points may be redeemed for rewards or "comps" for the player such as free meals or free rooms. Usually, the player tracking card inserted into the card reader contains at least player tracking account information including the players name and some personal information.

After inserting a player tracking card, the player may be visually prompted on the display screen 16 or aurally prompted using the speaker to enter identification information such as a personal identification number (PIN) using the key pad 22. Typically, the player tracking card may remain in the card reader 24 during the game play session. As another example, the gaming machine may transfer player tracking information from a portable wireless device worn by the player via a wireless interface device (not shown) on the gaming machine 2. An advantage of using a portable wireless device is that the transfer of player tracking information is automatic and the player does not have to remember to correctly insert a player tracking card into the gaming machine.

At 204, the player is involved in playing the game on the gaming machine. During the course of a game, a player may be required to make a number of decisions, which affect the outcome of the game. For example, a player may vary his or her wager on a particular game, select a prize for a particular game, or make game decisions which affect the outcome of a particular game. The player may make these choices using the player-input switches 32, the video display screen 34 or using some other device which enables a player to input information into the gaming machine. Certain player choices may be captured by player tracking software loaded in a memory inside of the gaming machine. For example, the rate at which a player plays a game or the amount a player bets on each game may be captured by the player tracking software.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 200 or, for example, from lights behind the belly glass 40.

FIG. 2 is intended to convey implementation of the invention during the normal course of operating a gaming machine, which includes game play. However, game play on the gaming machine is not essential to the method of the present invention. A player may add credits to a machine and subsequently decide not to play the game offered on the machine, but instead to cashout. In this case, player authentication of a cashless voucher generated by the machine on cashout may be obtained.

At 206, a cashout event occurs. This is typically initiated by a player pushing a cashout button on the machine after the player has completed a game. Among the options available for cashout, a cashless instrument may be generated at the gaming machine 2. The cashless instrument may be a printed ticket voucher, a smart card, debit card or other cashless medium. For example, the player may decide to cashout and may receive a voucher 20 from the printer 18, which may be used for further games or to redeem a cash prize. The player may view cashless instrument transaction information on the video display screen 34 or the player tracking display screen 16. For instance, when a player cashes out from the gaming machine, the value stored on the cashless instrument may be displayed using the video display 34.

The EZ PAY ticket voucher system (IGT, Reno, Nev.) is an example of a suitable cashless gaming system for implementation of the present invention. Further details of this cashless gaming system are provided in co-pending U.S. patent application Ser. No. 09/648,382, filed Aug. 25, 2000, by Rowe, titled "Cashless Transaction Clearinghouse," which is incorporated herein in its entirety and for all purposes.

In accordance with the present invention, when cashout is done by generation of a cashless instrument, such as a voucher, the player may select a player authentication technique to add security information to the instrument to identify the owner, at 208. For example, the gaming machine may prompt the player to select a player authentication technique by an audible query via a speaker 12, 14 or a text query via one of the display screens 34 or 16. Each player authentication technique will have an associated player authentication data acquisition interface, for example 50, by which the player provides some authentication data to be printed on the voucher (or otherwise placed on a cashless gaming instrument). A wide variety of player authentication data acquisition interfaces are available for implementation of the present invention, several of which are described below.

Player authentication data can be entered manually using a PIN, birth date or other information for identity confirmation, via a keypad. As noted above, the keypad used may be one that is dedicated to the player authentication purpose, or, more preferably, one that is available to receive input for a variety of purposes including player tracking, wagering, etc. In a preferred embodiment, the keypad provided in many conventional player tracking units may be used as a player authentication data interface in this way. This numeric or alphanumeric data can be read, stored, processed, and/or encoded (e.g., converted to barcode), and/or encrypted for printing as a security aspect on a cashless voucher (or otherwise placed on a cashless gaming instrument) generated by the machine on cashout.

The handling of data input into a gaming machine by keypad and the printing of coded and uncoded data on cashless vouchers by the gaming machine is a well known technique. The present invention adds a security aspect to cashless gaming machine instruments via these mechanisms by additionally placing player authentication data on the cashless instrument. The player will be asked to verify the authentication data on the voucher in order to authenticate the redemption of the voucher for cash. For example, a cashier will electronically read encoded authentication data printed on a voucher and ask the person presenting the voucher for redemption to confirm the PIN, birth date, or other authentication data entered by keypad and printed (in code and/or encrypted) on the voucher.

Another player authentication data interface that may be used is a touchscreen. For example, display 34 may be equipped with touchscreen technology to allow the display to receive input as well as provide output. Details of the use of touchscreen technology in gaming machines suitable for the implementation of the present invention are provided in co-pending U.S. patent application Ser. No. 09/961,051, filed Sep. 20, 2001, by Paulsen, et al., titled "Game Service Interfaces for Player Tracking Touch Screen Display," incorporated by reference herein it its entirety and for all purposes. In one embodiment, a player could enter her signature using the machine touchscreen. The signature could be converted to a digital image by the gaming machine and then printed on a cashless voucher on cashout. This signature can then be compared to the player's previously entered digitally stored signature filed with the gaming machine operator (e.g., casino), or to the signature on the player's driver's license if there is no previously recorded signature, when the voucher is presented to a cashier for redemption.

Player authentication data may also be input via a conventional gaming machine component configured for the task by logic. For example, a machine's bill validator may be configured to scan a player identification card, such as a driver's license or library card. The data so acquired may be placed (e.g., the image of the ID card printed) on a cashless instrument for player authentication purposes.

Other interfaces for acquiring player authentication data for placing on a cashless gaming instrument (e.g., printing on a voucher) include various biometric devices, such as fingerprint scanners, iris scanners, digital cameras (for acquiring a picture for image comparison or ratiometric (feature recognition) analysis), and/or a microphone (to obtain a digital file (signature) of the player's voice containing unique voice characteristic data), which collect player authentication data. Details of the use of such biometric technology in gaming machines suitable for the implementation of the present invention are provided in co-pending U.S. patent application Ser. No. 09/921,489, filed Aug. 3, 2001, by Hedrick et al., and titled, "Player Tracking Communication Mechanisms in a Gaming Machine," which is incorporated by reference herein in its entirety and for all purposes. In addition, a description of a finger print reader as an identification device is provided in co-pending U.S. application Ser. No. 09/172,787, filed Oct. 14, 1998, by Wells, et al., titled "Gaming Device Identification Method and Apparatus," which is incorporated herein in its entirety and for all purposes. In each case, the appropriate biometric interface is incorporated into the gaming machine and available to collect player authentication data that is then digitized and/or encoded and placed on a cashless gaming instrument generated by the machine on cashout.

While several player authentication data acquisition interfaces and techniques have been described above, it should be understood that any data acquisition method and apparatus suitable for acquiring a player authentication data or other data suitable for player authentication and placing it on a cashless gaming instrument so that it may later be read and authenticated may be used consistent with the principles of this invention.

Further, player authentication of vouchers in accordance with the present invention may be advantageously integrated with player tracking systems in a gaming machine. The use of player tracking unit components such as keypads and biometric devices to collect player authentication data have been described above. In addition, data from a player's player tracking card (name, picture, barcode data matrix, etc.) may be selected by the user to authenticate a voucher, or the player tracking data may automatically printed onto the voucher, for example, on cashout for this purpose. In this embodiment, the player is identified to the gaming machine and associated system at the start of the gaming session by insertion of a player tracking card. Player authentication data on the player tracking card may be sufficient for player authentication in accordance with the present invention and obviate the need to prompt the player to select a data acquisition technique at cashout. In other embodiments, biometric input devices may be used to supplement information read from a player tracking card. Details of player tracking technology in gaming machines suitable for the implementation of the present invention are provided in co-pending U.S. patent application Ser. No. 09/838,033, filed Apr. 19, 2001, by Criss-Puskiewicz, et al, titled "Universal Player Tracking System," which is incorporated herein in its entirety and for all purposes, co-pending U.S. patent application Ser. No. 09/642,192, filed Aug. 18, 2000, by LeMay, et al, titled "Gaming Machine Virtual Player Tracking Services," which is incorporated herein in its entirety and for all purposes, and co-pending U.S. patent application Ser. No. 09/921,489, previously incorporated by reference. The integration of player tracking and player authentication in accordance with the present invention has further advantages in allowing the unification of discrete databases and hardware, facilitating implementation on legacy machines with limited peripheral capacity, and allowing new game features based on a player's known player profile or play style.

It should be noted that, in accordance with some embodiments of the present invention, player authentication data may be anonymous. That is, the player authentication data placed on the cashless instrument may not convey any authentication information, and so may not identify the player as a particular person, thereby preserving the player's privacy. For example, the player may input a password or PIN via a keypad on the machine as her player authentication data. This data may be placed on the instrument, generally in coded form, generated by the machine on cashout. Then, the player may validate and redeem the instrument for cash by providing the password or code to the kiosk or cashier to identify herself as the owner of the instrument, without revealing her personal identity.

Once the player authentication technique is selected, the player authentication data is input via the associated data acquisition interface, at 210. The data is read and, where appropriate, digitized, encoded, encrypted, and/or stored. For instance, the data acquisition interface may be used with appropriate biometric software (e.g., fingerprint, iris or voice recognition) executed by: a) a logic device on the player authentication or tracking unit, b) a master gaming controller in a gaming machine, or c) another intelligent device on the gaming system. The player authentication techniques of the present invention are typically implemented in a networked gaming system in which various gaming machines are in communication with a server providing centralized services such as accounting, player tracking, etc. In some case, the details of the player authentication the player authentication and other cashless instrument data (e.g., voucher value, time and place of issue, etc.) may be reported to the system for accounting, auditing or other purposes.

At 212, at cashout a cashless instrument (e.g., voucher) with the player authentication data placed (e.g., printed) on it is generated. The data may be in plain text, encoded (e.g., in barcode or other data form), or other graphic forms (e.g., digital images of a player's signature or likeness). In some cases, the player authentication data may be combined with other encoded data on conventional tickets. In other cases, the player authentication data is printed in a separate field on the voucher.

At 214, in order to negotiate the cashless instrument (i.e., redeem it for cash/prizes or use it for game play), validation of the player authentication data on the instrument is required (e.g., the instrument holder must match or provide the authentication data printed on the voucher in order to cash it). In addition, according to some embodiments of the invention, validation of the player authentication data on the instrument is required in order to use the instrument for game play.

Figure 3:
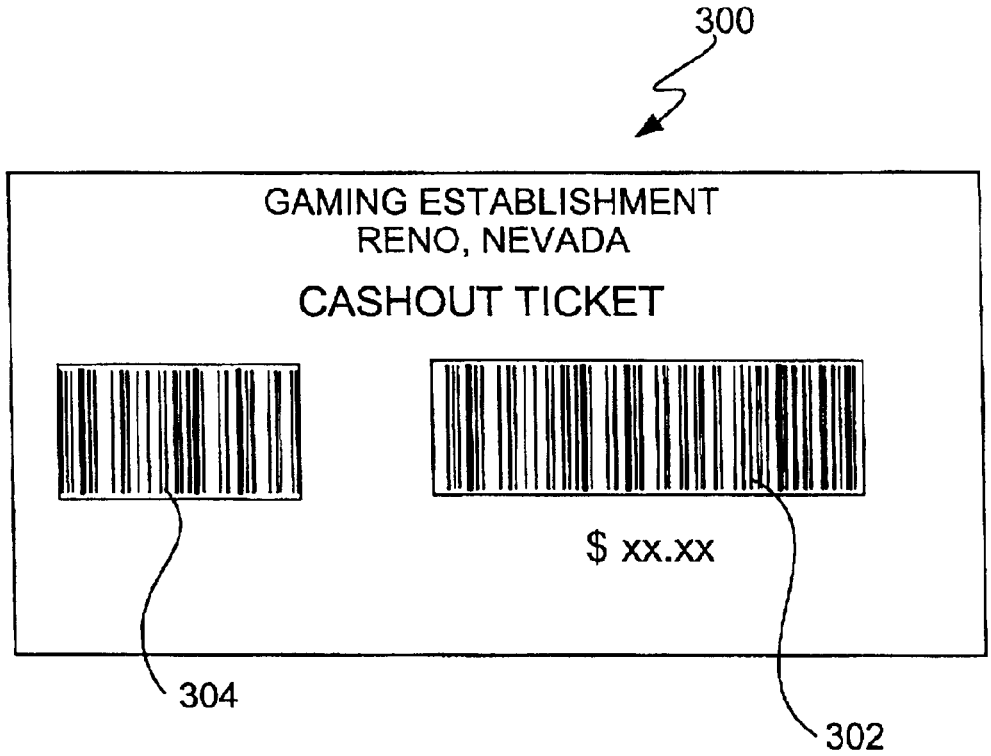
FIG. 3 is an illustration of a cashless gaming voucher with printed authentication data in accordance with one embodiment of the present invention.

FIG. 3 is an illustration of one type of cashless gaming instrument, a voucher with printed authentication data, in accordance with one embodiment of the present invention. The voucher 300 is an otherwise standard cashout ticket from a cashless gaming system, such as IGT's EZ PAY. The voucher includes machine-readable bar coding 302 providing data generally including the name and address of the issuing gaming establishment, the cash value of the voucher, etc. (see list above). The voucher also includes printed player authentication data generated through the player authentication system described above. In this example, the player authentication data is printed as barcode in a separate field 304. It should be understood that the invention is not limited to player authentication data printed as barcode as shown in this example. As described above, the player authentication data printed on a voucher (or otherwise stored on a cashless gaming instrument) may be in the form of the player's hand written signature, photograph, fingerprint, etc. These forms of player authentication data would not require encoding or encryption. When the voucher is presented to a cashier for redemption the player authentication data will be checked to verify that the person presenting the voucher for redemption is the rightful owner of the voucher.

It should also be understood that, while the invention is described primarily herein with reference to the printing of player authentication data on a cashless voucher, the principles of the invention may also be applied to the placement of player authentication data on other cashless instrument media, such as a smart card. Details of smart card technology in gaming machines suitable for the implementation of the present invention are provided in co-pending U.S. patent application Ser. No. 09/718,974, filed Nov. 22, 2000 by Rowe, titled "EZ PAY SMART CARD AND TICKET SYSTEM," which is incorporated herein in its entirety and for all purposes. Further, rather than generating a tangible instrument, such as a voucher or smart card, the gaming machine system may be configured to accept player instructions to have an electronic instrument ("virtual ticket"), wherein the instrument medium is an electronic data file and the player authentication data is stored in the file. The virtual ticket, including the instrument value and player authentication data may be transmitted to the user via a wired (e.g., Internet e-mail) or a wireless medium (e.g., pumped into a memory storage device such as a PDA, cell phone or memory stick) using communications protocols known in the art such as are noted below. The player may then use this electronic instrument for game play or cash redemption, either in its electronic form in a gaming machine, kiosk or cashier's device configured to accept and read the data, for example using well known hardware interfaces and communications protocols. Or, the player may convert the electronic instrument to a tangible instrument, such as by printing a voucher bearing the instrument value and player authentication data, or storing the electronic instrument data to a smart card, and then use that tangible instrument for game play or cash redemption.

A gaming machine suitable for implementation of the present invention is further described with reference to FIG.

Figure 4:
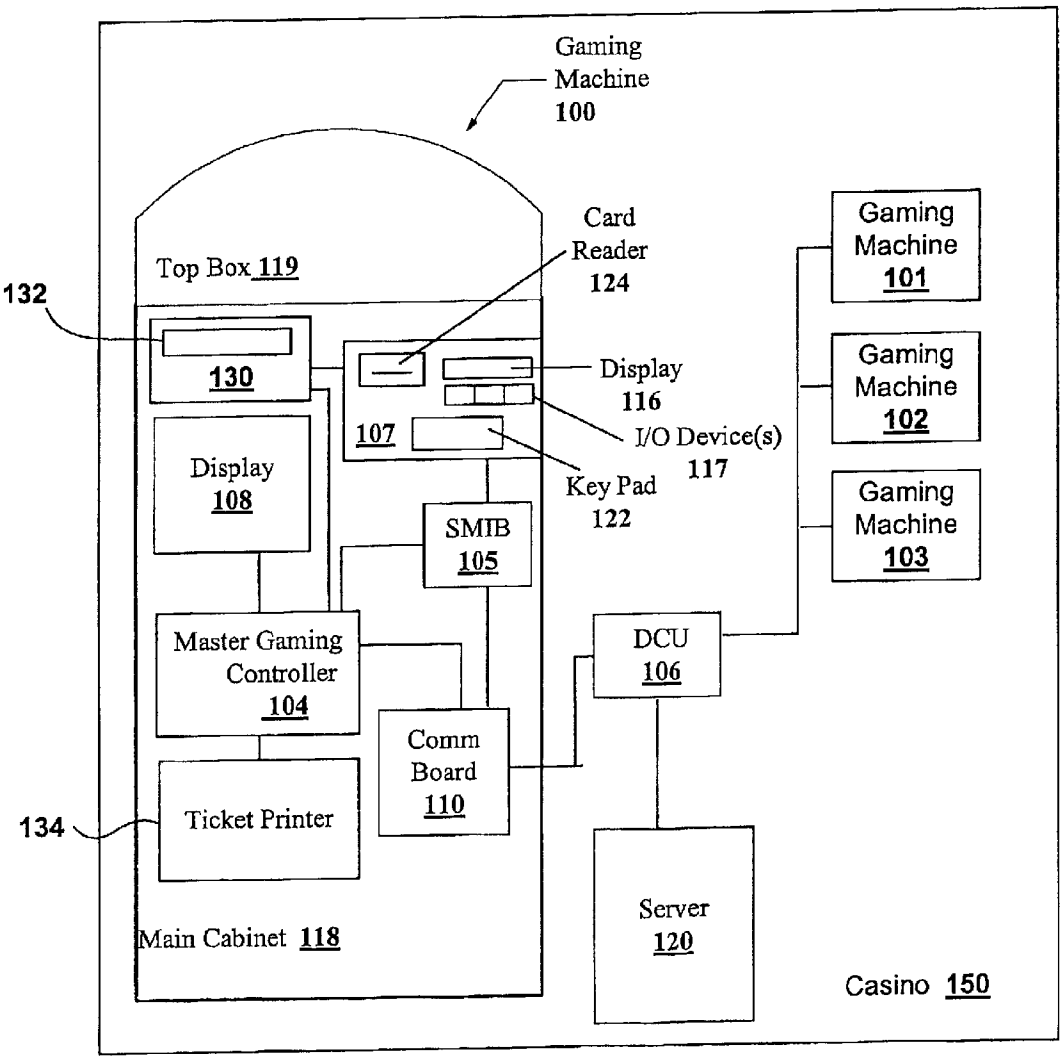
FIG. 4 is a block diagram illustrating elements of a system supporting player authentication for cashless gaming instruments in accordance with the present invention.

4. FIG. 4 is a block diagram of a number of gaming machines connected to servers providing associated services, such as accounting, player tracking and player authentication. In casino 150, gaming machines 100, 101, 102 and 103 are connected, via the data collection unit (DCU) 106 to the server 120. The DCU 106, which may be connected to up to 132 player tracking units as part of a local network in a particular example, consolidates the information gathered from player tracking and player authentication units in gaming machines 100, 101, 102 and 103 and forwards the information to the server 120. Among the functions of the server are 1) to store player tracking account information, such as information regarding a player's identity and previous game play, 2) to calculate player tracking points based on a player's game play that may be used as basis for providing rewards to the player, 3) store player authentication data for cashless instrument authentication, and 4) other marketing and promotional purposes.

In gaming machine 100 of casino 150, a master gaming controller 104 controls various combinations of devices that allow a player to play a game on the gaming machine and also encourage game play on the gaming machine, etc. It should be noted that in other embodiments, one or more other intelligent devices in a gaming system network may control one or more of the machine devices. The master gaming controller 104 is connected with a main, usually video, display 108, with a player authentication unit 130 and with player tracking unit 107 via a main communication board 110 and a slot machine interface board (SMIB) 105, all of which are mounted within a main cabinet 118 of the gaming machine. The machine also includes a ticket printer 134, interconnected as a peripheral with the other components of the gaming machine 100, which may print barcoded tickets or vouchers. The printer may be a stand alone component, or may be part of one or more functional units of the machine 100, such as the player tracking unit 107 or the player authentication unit 130. The player authentication unit also includes one or more player authentication data acquisition devices 132. In the illustrated embodiment, the player authentication features of the present invention are depicted as being implemented as a discrete player authentication unit 130 interconnected as a peripheral with the other components of the gaming machine 100. The player authentication features may also be implemented as part of one or more other components of the machine, in particular the player tracking unit. When both are present, the player authentication unit 130 and the player tracking unit may be directly connected so that they may more easily share I/O devices and drivers and data. A top box 119 is mounted on top of the main cabinet 118 of the gaming machine. Player authentication and/or player tracking units may be mounted within the top box 119 or the cabinet 118, or may be mounted externally.

The player tracking unit 107 includes a variety of player tracking devices, including a card reader 124, a key pad 122, and a display 116, usually a vacuum fluorescent display (VFD) or liquid crystal display (LCD), all mounted within the unit. Other player tracking I/O devices may also be used, as represented by 117, for example, various biometric devices such as a digital camera, a microphone, or a fingerprint or iris scanner. As noted above, these player tracking devices may also be used to acquire player authentication data for use in a player authentication system in accordance with the present invention. The I/O devices are used to input player tracking information that is needed to implement the player tracking program and to acquire player data needed to implement the player authentication system. The player tracking unit 107 communicates with the server via the SMIB 105, a main communication board 110 and the data collection unit 106. The SMIB 105 allows the player tracking unit 107 to gather information from the gaming machine 100 such as an amount a player has wagered during a game play session. This information may be used by the player tracking server 120 to calculate player tracking points for the player. The player tracking 107 and player authentication units (whether two separate units or integrated as one) are usually connected to the master gaming controller 104 via a serial connection of some type and communicate with the master gaming controller 104 using a communication protocol of some type. For example, the master gaming controller 104 may employ the Slot Accounting System (SAS protocol) developed by International Game Technology of Reno, Nev. to communicate with the player tracking and authentication units.

The player authentication unit may include a logic device having a processor for executing software allowing the unit to perform various player authentication functions such as communicating with the server 120, communicating with the master gaming controller 104 or operating the various peripheral devices such as the authentication data acquisition device(s) 132 and the printer 134. In one embodiment, application software for the player authentication unit and configuration information for the player authentication unit may be stored in a memory device such as an EPROM, a non-volatile memory, hard drive or a flash memory.

The player authentication unit 130 may include a memory configured to store: 1) player authentication software such as player authentication data collection software, 2) player authentication communication protocols allowing the player authentication unit 130 to communicate with different types of servers (e.g., 120), 3) device drivers for many types of player authentication data acquisition devices (e.g. 132), 4) biometric (e.g., fingerprint, iris or voice recognition) software for acquiring and processing data from the device(s) 132, 5) a secondary memory storage device such as a non-volatile memory device, configured to store gaming software related information (The gaming software related information and memory may be used in a game download process or other software download process.), and 6) communication transport protocols such as TCP/IP, USB, IEEE1394, Bluetooth, IEEE 802.11×(e.g., all IEEE 802.11 standards), HiperLAN/2, and HomeRF allowing the player authentication 130 unit to communicate with devices using these protocols or communication protocols allowing the logic device to communicate with different types of master gaming controllers (e.g. master gaming controllers using different types of communication protocols), such as 104. Typically, the master gaming controller, such as 104, communicates using a serial communication protocol. A few examples of serial communication protocols that may be used to communicate with the master gaming controller include but are not limited to USB, RS-232 and Netplex (a proprietary protocol developed by IGT, Reno, Nev.).

A plurality of device drivers may be stored in memory for each type of player authentication data acquisition peripheral device. When one type of a particular peripheral device is exchanged for another type of the particular device, a new device driver may be loaded from the memory by the processor to allow communication with the device.

It should be noted from the above description that the player authentication unit may be conceptual in that its hardware components may be made up from other devices existing in conventional gaming machines configured by logic to perform the functions needed to implement the present invention, as would be understood by one of skill in the art from this disclosure.

CONCLUSION

The present invention provides a gaming system and method capable of providing security to a cashless gaming instrument such as a ticket or voucher by placing player authentication data, such as personal information data, on the instrument. Among the advantages of the invention are that it enhances security and acceptability of cashless gaming systems and, in embodiments where it is implemented with player tracking systems, it allows an interface between player tracking and cashless instrument player authentication systems to the mutual benefit of the player and the gaming machine/system operator.

Although the foregoing invention has been described in some detail for purposes of clarity of understanding, it will be apparent that certain changes and modifications may be practiced within the scope of the appended claims. It should be noted that there are many alternative ways of implementing both the process and compositions of the present invention. For instance, while the gaming machines of this invention have been depicted as having a top box mounted on top of the main gaming machine cabinet, the use of gaming devices in accordance with this invention is not so limited. Further, while several player authentication data acquisition techniques have been described above, it should be understood that any data acquisition method suitable for acquiring player authentication data and placing it on a cashless instrument so that it may later be read and validated may be used consistent with the principles of this invention. Accordingly, the present embodiments are to be considered as illustrative and not restrictive, and the invention is not to be limited to the details given herein, but may be modified within the scope and equivalents of the appended claims.

What is claimed is:

1. A method of authenticating a cashless gaming instrument, comprising:

acquiring player authentication data via a device on a gaming machine;

printing the player authentication data on the cashless gaming instrument when the instrument is issued at the gaming machine; and requiring validation of the player instrument authentication data printed on the cashless gaming instrument for negotiation of the cashless gaming instrument.

2. The method of claim 1, wherein said player authentication data is acquired via a player tracking system implemented on the machine.

3. The method of claim 2, wherein said player authentication data is acquired from a player tracking card inserted into the machine.

4. The method of claim 1, wherein said player authentication data is acquired via a keypad entry.

5. The method of claim 1, wherein said player authentication data is a signature entered via a touchscreen implemented on the machine.

6. The method of claim 1, wherein said player authentication data is an image of a personal identification card entered via a scanner implemented on the machine.

7. The method of claim 1, wherein said player authentication data is acquired via a biometric device implemented on the machine.

8. The method of claim 7, wherein the biometric device is selected from the group consisting of a fingerprint scanner, and iris scanner, a digital camera and a microphone.

9. The method of claim 7, wherein the biometric device is a fingerprint scanner and the player authentication data is fingerprint image data.

10. The method of claim 7, wherein the biometric device is an iris scanner and the player authentication data as iris image data.

11. The method of claim 7, wherein the biometric device is a digital camera and the player authentication data is a photographic image.

12. The method claim 7, wherein the biometric device is a digital camera and the player authentication data is ratiometric facial data.

13. The method of claim 7, wherein the biometric device is a digital microphone and the player data is unique voice characteristic data.

14. The method of claim 1, wherein the negotiation of the instrument comprises use of the instrument for redemption of a prize or a complimentary award.

15. The method of claim 14, wherein the data is at least one of encoded or encrypted.

16. The method of claim 14, wherein the data is printed in barcode.

17. The method of claim 1, wherein the negotiation of the instrument comprises cash redemption of the instrument.

18. The method of claim 1, wherein the negotiation of the instrument comprises use of the instrument for game play.

19. A gaming machine, comprising:

a master gaming controller designed or configured to control a game play sequence comprising a presentation of one or more games on the gaming machine;

a cashless gaming instrument input mechanism coupled to said master gaming controller a player authentication data acquisition mechanism coupled to said master gaming controller for receiving player authentication data; and a printer designed or configured to generate a cashless gaming machine instrument and print player authentication data acquired by the acquisition mechanism on the cashless gaming instrument when the instrument is issued at the gaming machine wherein negotiation of the cashless gaming instrument requires validation of the player authentication data printed on the cashless gaming instrument.

20. The gaming machine of claim 19, further comprising a player tracking unit coupled to said gaming controller.

21. The gaming machine of claim 20, wherein the player authentication data acquisition mechanism is a card reader for a player tracking card inserted into the machine.

22. The gaming machine of claim 19, wherein the player authentication data acquisition mechanism is a keypad implemented on the machine.

23. The gaming machine of claim 19, wherein the player authentication data acquisition mechanism is a touchscreen implemented on the machine.

24. The gaming machine of claim 19, wherein said player authentication data is an image of a personal identification card entered via a scanner implemented on the machine.

25. The gaming machine of claim 19, wherein the player authentication data acquisition mechanism is a biometric device implemented on the machine.

26. The gaming machine of claim 25, wherein the biometric device is selected from the group consisting of a fingerprint scanner, and iris scanner, a digital camera and a microphone.

27. The gaming machine of claim 25, wherein the biometric device is a fingerprint scanner and the player authentication data is fingerprint image data.

28. The gaming machine of claim 25, wherein the biometric device is an iris scanner and the player authentication data is an iris image data.

29. The gaming machine of claim 25, wherein the biometric device is a digital camera and the player authentication data is a photographic image.

30. The gaming machine of claim 25, wherein the biometric device is a digital camera and the player authentication data is ratiometric facial data.

31. The gaming machine of claim 25, wherein the biometric device is a digital microphone and the player authentication data is unique voice characteristic data.

32. The gaming machine of claim 19, wherein the negotiation of the instrument comprises use of the instrument for one or more of a redemption of the instrument for a prize, a redemption of the instrument for a complimentary award, a redemption of the instrument for cash or a redemption of the instrument for game play.

33. A cashless gaming instrument, comprising:

an instrument medium;

player authentication data identifying a gaming player as owner of the cashless instrument printed on the instrument medium when the instrument medium is issued at a gaming machine wherein negotiation of the cashless gaming instrument requires validation of the player authentication data printed on the cashless gaming instrument.

34. The instrument of claim 33, wherein the instrument medium is a printable substrate and the player authentication data is printed on the substrate.

35. The instrument of claim 34, wherein the instrument is a gaming machine voucher.

36. The instrument of claim 34, wherein the authentication information is at least one of encoded or encrypted.

37. The instrument of claim 33, wherein the negotiation of the instrument comprises use of the instrument for one or more of a redemption of the instrument for a prize, a redemption of the instrument a complimentary award, a redemption of the instrument for cash or a redemption of the instrument for game play.

38. The instrument of claim 33, wherein the player authentication data is one or more of a PIN number known to the game player, a signature of the gaming player or biometric information from the game player.

39. The method of claim 1, wherein a portion the player authentication information printed on the cashless gaming instrument is received from a remote device.

40. A method of negotiating a cashless gaming instrument, comprising:

receiving the cashless gaming instrument including first player authentication data printed on the cashless gaming instrument wherein the first player authentication data associates the cashless gaming instrument to a game player and wherein the first player authentication data is printed on the cashless gaming instrument when the cashless gaming instrument is issued at a gaming machine;

receiving second player authentication data wherein the second player authentication data is one of information known by the game player or biometric information received from the game player;

comparing validation data obtained using the first player authentication data printed on the cashless gaming instrument with the second player authentication data; and redeeming the cashless gaming instrument when a match is determined between the validation data and the second player authentication data.

41. The method of claim 40, further comprising receiving at least a portion of the validation data from a remote device.

42. The method of claim 40, wherein the redemption of the instrument comprises use of the instrument for one or more of a redemption of the instrument for a prize, a redemption of the instrument for a complimentary award, a redemption of the instrument for cash or a redemption of the instrument for game play.

* * * * *